US005525113A

United States Patent [19]

Mitchell et al.

[11] Patent Number: 5,525,113

[45] Date of Patent: Jun. 11, 1996

[54] OPEN TOP SWING & CONTROL

[75] Inventors: Daniel R. Mitchell, Morgantown; Scott B. Caley, Elverson; Truman Allison, York, all of Pa.

[73] Assignee: Graco Childrens Products Inc., Elverson, Pa.

[21] Appl. No.: 322,125

[22] Filed: Oct. 13, 1994

Related U.S. Application Data

[63] Continuation-in-part of Ser. No. 13,747, Oct. 1, 1993.

[51] Int. Cl.[6] ..... A63G 9/16

[52] U.S. Cl. ..... 472/119; 472/118; 74/48

[58] Field of Search ..... 472/118, 119; D6/347, 333, 344; 74/48; 185/40 C

[56] References Cited

U.S. PATENT DOCUMENTS

| | | |
|---|---|---|
| D. 250,861 | 1/1979 | Boudreau et al. . |
| D. 293,046 | 12/1987 | Richm . |
| D. 348,157 | 6/1994 | Amburgey et al. . |
| D. 349,819 | 8/1994 | Noll . |
| D. 351,289 | 10/1994 | Stephens et al. . |
| 1,282,927 | 10/1918 | Paskal . |
| 1,439,619 | 12/1922 | Dziedzic . |
| 1,458,049 | 6/1923 | Grieshaber . |
| 1,505,049 | 6/1923 | Grieshaber . |
| 1,505,117 | 8/1924 | Withun . |
| 1,906,768 | 5/1933 | Romine . |
| 2,024,855 | 12/1935 | Goetter . |
| 2,076,675 | 4/1937 | Sharp . |
| 2,564,547 | 8/1951 | Schrougham . |
| 2,609,031 | 9/1952 | Puscas . |
| 2,807,309 | 9/1957 | Saint et al. . |
| 2,908,917 | 10/1959 | Pinson . |
| 2,972,152 | 2/1961 | Vincent . |
| 2,979,734 | 4/1961 | Saint et al. . |
| 3,071,339 | 1/1963 | Saint . |
| 3,128,076 | 4/1964 | DiPasqua . |
| 3,146,985 | 9/1964 | Grudoski . |
| 3,166,287 | 1/1965 | DiPasqua . |
| 3,459,423 | 8/1969 | Meade . |
| 3,526,400 | 9/1970 | Carpenter et al. . |
| 3,692,305 | 9/1972 | Allen . |
| 3,818,517 | 6/1974 | Casella . |
| 3,842,450 | 10/1974 | Pad . |
| 4,150,820 | 4/1979 | Bochmann . |
| 4,452,446 | 6/1984 | Saint . |

(List continued on next page.)

FOREIGN PATENT DOCUMENTS

| | | |
|---|---|---|
| 450755 | 8/1949 | Italy . |
| 497871 | 9/1954 | Italy . |
| 1070921 | 7/1967 | United Kingdom . |

*Primary Examiner* Kien T. Nguyen
*Attorney, Agent, or Firm* Pennie & Edmonds

[57] ABSTRACT

An open top swing assembly uses a unique swing drive mechanism and a control to provide three selective swing height settings. The assembly has a frame which provides an open top structure for ease of access and a trapezoidal shaped front base to provide foot clearance. The swing drive mechanism includes a drive sleeve rotatably mounted to an axle that operatively supports the hanger. A drive flange is mounted on the axle, with a drive flange coupling device positioned between the sleeve and the drive flange to provide a limited lost motion connection. The coupling device includes a hub member coaxially and rotatably mounted on the axle and at least one torsional spring mounted coaxially on the hub member. The hub member includes abutments for engaging with the drive flange, whereby torque applied to the sleeve is transferred to the axle. A crank driven by a motor is linked to the sleeve to oscillate the sleeve. The swing height control device can have a sensor for detecting the swing height or amplitude. Preferably, three swing height settings are provided. The control device selectively outputs either no voltage, first, second or third predetermined voltages to selectively control the voltage input to the motor based on the selection of the swing height setting and/or the sensed swing height to achieve the selected swing height.

44 Claims, 13 Drawing Sheets

U.S. PATENT DOCUMENTS 4,491,317 1/1985 Bansal .
4,722,521 2/1988 Hyde et al. .
4,785,678 11/1988 McGugan et al. .
4,805,902 2/1989 Casagrande .
4,807,872 2/1989 Spilman et al. .
4,822,033 4/1989 Kohus et al. ..... 472/119
4,911,429 5/1990 Ogbu .
5,326,326 7/1994 Cunard et al. .
5,326,327 7/1994 Stephens et al. .

OPEN TOP SWING & CONTROL

This is a continuation-in-part of design application Ser. No. 29/013,747 filed on Oct. 1, 1993.

BACKGROUND

Different types ok swings for an infant or child have been contemplated in the past. A swing typically comprises a support frame, a seat and at least one hanger attached to the seat, the seat and the hanger defining a swing carriage, and a swing drive mechanism operatively connected to the hanger for maintaining the pendular movement of the swing carriage. If the swing carriage swings with no mechanical friction and no wind resistance, only a single push would be needed to maintain the swing in a perpetual pendulum motion. In such a case, the swing will maintain its amplitude indefinitely and a swing drive mechanism would not be necessary. However, such is not the case in reality, as wind resistance and bearing friction are always present. The mechanical or bearing friction can be reduced such that it becomes negligible. However, the wind resistance cannot be eliminated. The bigger the child, the more wind resistance will there be. It is the wind resistance that mainly dampens the swing amplitude, requiring use of a swing drive mechanism to supply energy lost and maintain its pendular movement.

Typically, the swing drive mechanism is either electrically powered or manually powered. The electrically powered drive mechanism generally uses a DC or AC motor or solenoid, as described for instance in U.S. Pat. No. 4,452,446 issued to Saint; U.S. Pat. No. 4,491,317 issued to Bansal; U.S. Pat. No. 4,722,521 to Hyde et al. The manually powered drive mechanism typically uses a spring wind-up mechanism which can be manually rotated using a crank to store energy within the spring, as described for instance in U.S. Pat. Nos. 3,128,076 and 3,166,287 issued to Pasqua; and U.S. Pat. No. 3,459,423 issued to Meade.

SUMMARY

The present invention relates to an open top swing frame, an electrically powered swing drive mechanism, a swing height or amplitude control for providing selectable swing amplitudes, and an open top swing assembly using the same. The open top support frame according to the present invention has a rear horizontal base, a substantially trapezoidal shaped front base, first, second, third and fourth legs, and first and second connectors. Specifically, the first and second legs extend upwardly, substantially parallel to one another, at an incline from the ends of the rear base. Similarly, the third and fourth legs extend upwardly, substantially parallel to one another, at an incline from the ends of the front base. The first and third legs converge toward each other, as well as the second and fourth legs in a similar fashion. The first and third leg pair and the second and fourth leg pair can be made substantially parallel and symmetrical to each other. A first connector is attached to the first and third leg pair to maintain them at a fixed position relative to each other and to the first connector. Similarly, the second connector is attached to the second and fourth leg pair to maintain them at a fixed position relative to each other and to the second connector.

The rear and front bases are substantially on the same plane, namely on the floor to support the entire frame thereon. The trapezoidal shaped front base has its median arm joined by a pair of laterally and forwardly extending arms so that the opening thereof faces away from the rear base, or rather faces toward the front. The median arm is substantially parallel to and closer to the rear base. The opening created by the trapezoidal shaped front base provides an obstruction free foot clearance for the person seating or removing an infant or child from the swing.

A first pivot or pendulum axle is rotatably journaled to the first connector and a second pivot or pendulum axle is rotatably journaled to the second connector. A pair of hangers extending laterally from the seat can be connected to the first and second pendulum axles such that the seat can oscillate thereabout. Preferably, the first and second axles are aligned so that their axes are collinear about a same horizontal axis.

While it is not necessary, a hub can be use to connect the axles to the hangers, with one of the hangers mounted to one of the hubs and the other of the hangers mounted to the other of the hubs. Each of the hubs can have an overrotation stop which cooperates with a cooperating overrotation stop mounted on each of the first and second connectors adjacent to each of the hubs to prevent overrotation of the hubs relative to the first and second connectors and thus prevent overrotation of the swing carriage.

Another feature of the present invention is a swing drive mechanism. Although it is preferable to use an open top swing frame described above with the drive mechanism according to the present invention, the present drive mechanism can be used with any conventional swing. The drive mechanism comprises a drive sleeve mounted coaxially and rotatably about an axle so that it can substantially freely rotate thereabout. A drive flange is mounted on the axle with no relative rotational movement therebetween. A drive flange coupling device is positioned between the drive sleeve and the drive flange to cause the axle to oscillate with the sleeve in the same direction. A crank driven by a motor via a gear reduction train is linked to the sleeve to oscillate the sleeve and thus the axle via the coupling device and the drive flange.

The sleeve includes a channel radially spaced from the axle and extends parallel with the axle. The crank basically rotates about an axis that is perpendicular to the axle. The crank has a driven portion that is offset from the axis of rotation of the crank. Accordingly, rotation of the crank causes its offset driven portion to follow a circular orbit path whose radius is the distance of the offset. The offset driven portion preferably has a ball that is rotatably mounted thereabout. The ball is slideably mounted in the channel such that rotation of the crank enables the sleeve to oscillate about the axis of the axle while the ball slideably oscillates back and forth within the channel. Means other than the ball, such as a cylinder or universal pivot, can be attached to the driven portion to carry out the same function.

The coupling device comprises a hub member coaxially and rotatably mounted on the axle and at least one torsional spring mounted coaxially on the hub member. The hub member includes abutments for engaging with the drive flange, whereby torque applied to the sleeve is transferred to the spring which can cause the hub member to rotate relative to the axle which in turn can cause the abutments to engage the drive flange and transfer torque to the axle. Preferably, the spring is provided with a limited free play and sufficient travel before it engages with the sleeve and to allow the swing carriage to swing when the motor is stopped, or to allow the motor to rotate when the swing carriage is stopped, without causing damage to the swing drive mechanism. During the interim when the free play (lost motion) is operational, the sleeve is decoupled from the axle and thus from the swing carriage.

The motor has its output shaft mounted substantially perpendicularly to the axle with the crank rotating about an axis perpendicular to both the output shaft and the axle. Preferably, a flywheel is attached to the motor.

Another aspect of the present invention is a swing height or amplitude control which can be used with the swing drive mechanism according to the present invention. The swing height control according to the present invention, however, can be used to control any conventional swing having a motor operated swing drive mechanism. The control can provide at least two swing height settings (first and second), where the first setting is smaller than the second setting, where it simply outputs either a first or second predetermined voltage to the motor based on the selection of the swing height setting, where the first voltage is lower than the second voltage.

The control can also include a sensor for continuously detecting the swing height or amplitude. Where the control provides at least first and second swing height settings, the control can output either no voltage, a first predetermined voltage or a second predetermined voltage to selectively control the voltage input to the motor based on the selection of the swing height setting and the sensed swing height to achieve the desired swing height. The control can also provide three or more swing height settings (first, second, and third), with the third setting being the largest. In this regard, the control selectively outputs either no voltage, the first predetermined voltage, the second predetermined voltage or a third predetermined voltage, with the third being the greatest. The control can be made to output as many (or more) different voltage outputs as there are different swing amplitude settings.

In operation, using the sensor with the three height setting, upon selection of the first swing height setting, the first voltage is continuously applied to the motor regardless of the swing height detected. Preferably, when and if the detected swing height exceeds the selected swing height setting, the voltage can be cut-off to the motor for the duration of the portion of the swing cycle that exceeds the selected first height setting to provide a more accurate swing height setting.

If the second swing height setting is selected, again the first voltage is initially input to the motor until the detected swing height exceeds the first swing height setting. Upon the swing height exceeding the first swing height setting, the second voltage is applied to the motor only for the duration of the portion of the swing cycle that exceeds the first swing height setting.

If the third swing height setting is selected, again the first voltage is initially applied to the motor until the detected swing height exceeds the first swing height setting. Upon the swing height exceeding the first swing height setting, the third voltage is applied to the motor for the duration of the portion of the swing cycle that exceeds the first swing height setting.

Preferably, when and if the swing height is greater than the third swing height setting, to prevent excessively high swing height, the first voltage is applied to the motor for the duration of the portion of the swing cycle that exceeds the third swing height setting.

BRIEF DESCRIPTION OF THE DRAWINGS

These and other features, aspects, and advantages of the present invention will become much more apparent from the following description, appended claims, and accompanying drawings where:

DESCRIPTION OF THE DRAWINGS

Figure 1:
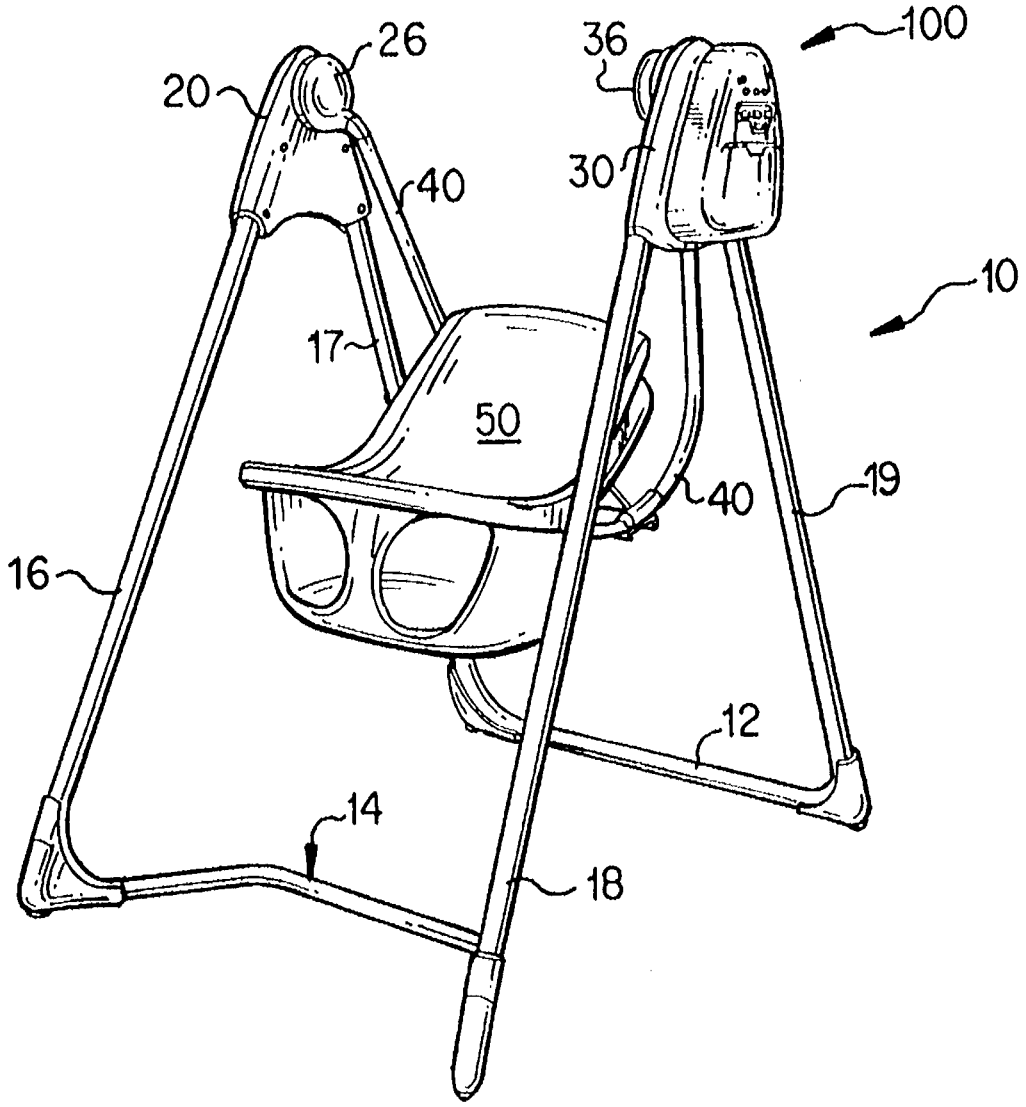
FIG. 1 is a perspective view of an open top swing according to the present invention.

FIG. 1 shows an embodiment of a swing according to the present invention, which has a support frame 10 which holds a swing drive mechanism 100, a pair of hangers 40, and a seat 50. The support frame 10 according to the present invention has an open top design. It has no overhang support member to make removal and seating of an infant to and from the swing seat convenient. The open top frame 10 has a rear horizontal base 12, a substantially trapezoidal shaped front base 14, a front left leg 16, a rear left leg 17, a front right leg 18 and a rear right leg 19 in a splayed position as shown in FIG. 1, a left leg connector 20 and a right leg connector 30. The rear left and right legs 17,19 extend upwardly, substantially parallel to one another, at an incline or angle from the ends of the rear base 12. Similarly, the front left and right legs 16 and 18 extend upwardly, substantially parallel to one another, at an incline from the ends of the front base 14. The front and rear left legs 16,17 incline in the opposite directions such that they converge toward each other as shown in FIG. 1. Similarly, the front and rear right legs 18,19 incline in the opposite directions such that they too converge toward each other. The front and rear left leg pair 16,17 can be substantially parallel and symmetrical to the front and rear right leg pair 18,19 if desired.

The left leg connector 20 connects the front and rear left legs 16 and 17 to maintain them at a fixed position relative to each other. Similarly, the right leg connector 30 connects the front and rear right legs 18,19 to maintain them at a fixed position relative to each other.

Figure 1A:
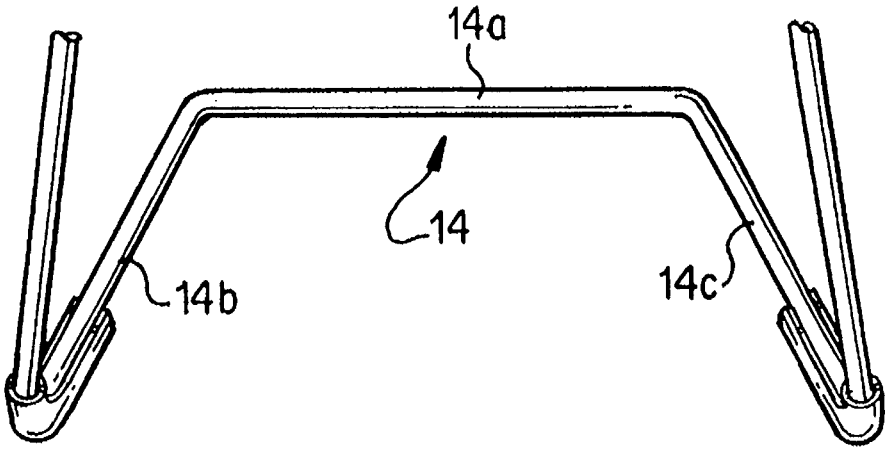
FIG. 1A is a top elevational view of a portion of FIG. 1, showing the front base of the open top swing frame according to the present invention.
Figure 2:
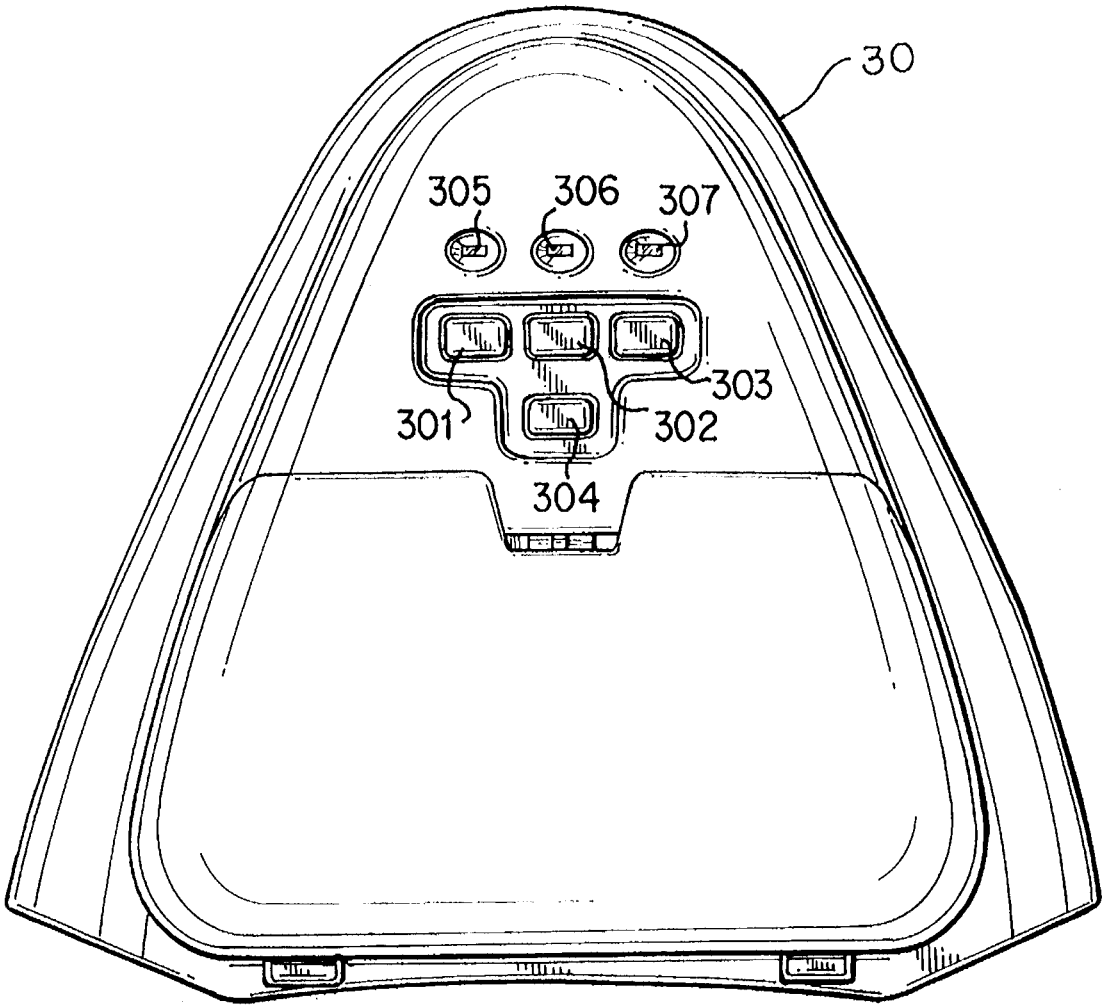
FIG. 2 is an enlarged side view of the right leg connector which houses the swing drive mechanism and associated control.
Figure 3:
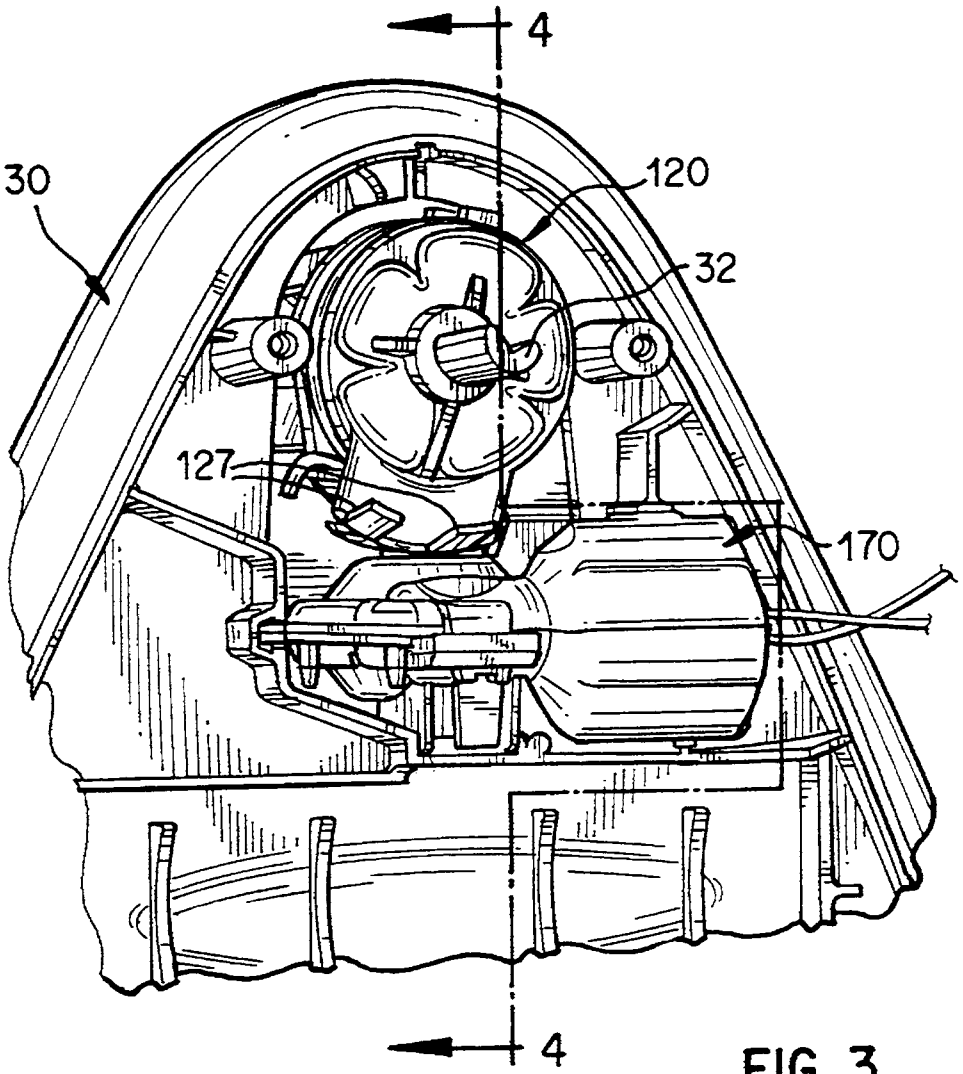
FIG. 3 is a perspective view of FIG. 2, with its cover removed, showing the swing drive mechanism.

The rear and front bases are substantially on the same plane, namely on the floor to support the entire frame thereon. The front base is substantially trapezoidal shaped. Specifically, as shown in FIG. 1A, the front base is formed by a horizontal median arm 14*a* joined by a pair of oppositely extending arms 14*b*,14*c*. The arms 14*b*,14*c* are angled greater than 90° with respect to the median arm 14*a* such that they form a trapezoidal shape. The front base extends inwardly toward the rear base with the median arm 14*a* preferably parallel to the rear base. Due to this feature, the front base provides an opening or clearance space which enables one to move close to the seat during seating or removal of an infant or child from the swing, i.e., foot clearance.

As shown in FIGS. 3, 4, 6, and 11, a right pendulum axle 32 is rotatably journaled via axially spaced apart bearings 34 or the like on the right leg connector which houses the swing drive mechanism 100. A left pendulum axle 22 can be rotatably journaled via axially spaced apart bearings 24 or the like on the left leg connector in the similar fashion. The ends of the left and right hangers 40 which extend laterally from the seat 50 can be operatively connected to the left and right pendulum axles, respectively, to enable the seat to swing or oscillate about the axles. The left and right pendulum axles can be aligned so that their axes are collinear about a same horizontal axis to maintain an equal pendulum left and right hanger length.

Figure 4:
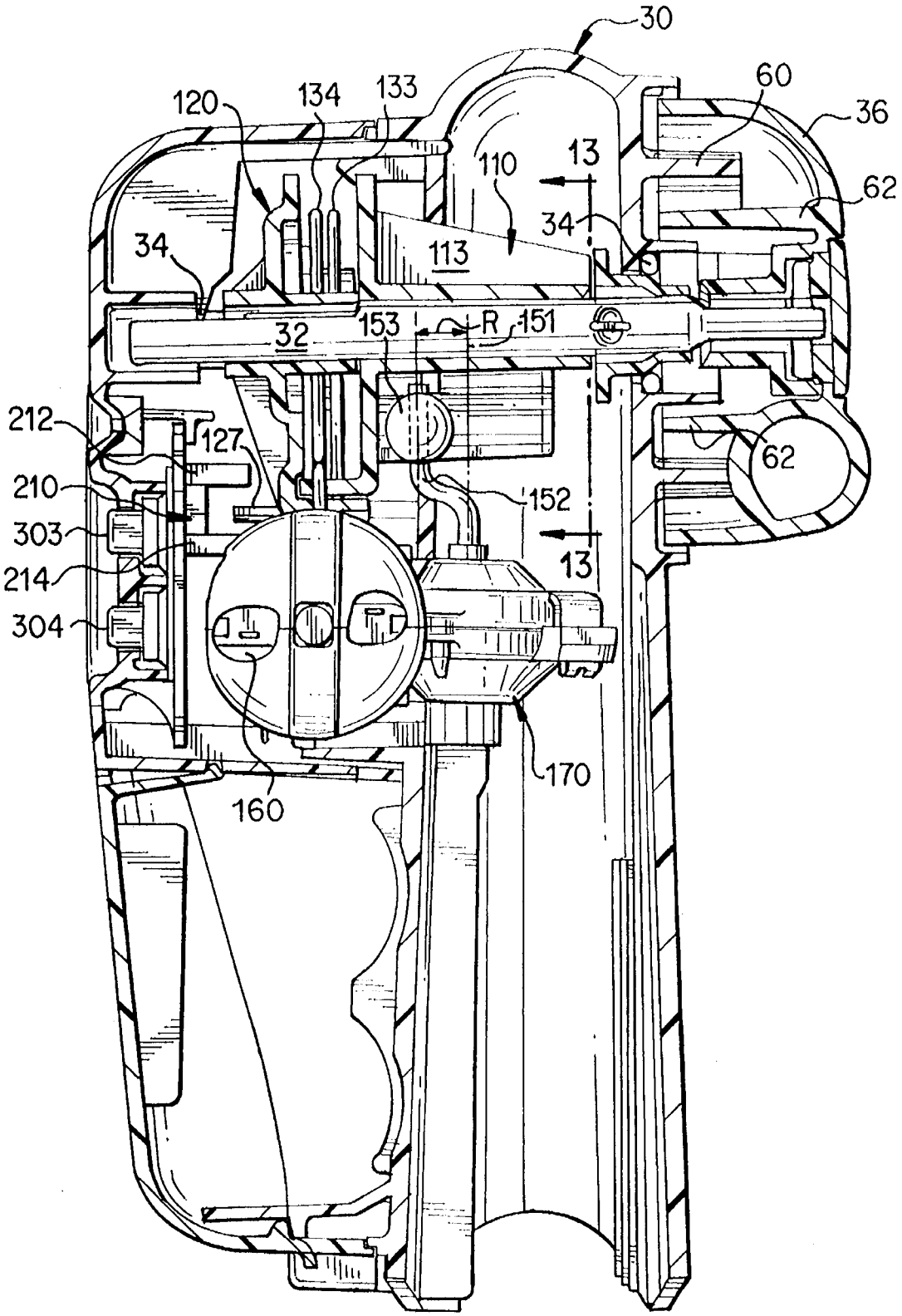
FIG. 4 is a sectional view taken along line 4—4 of FIG. 3, showing the details of the swing drive mechanism.
Figure 6:
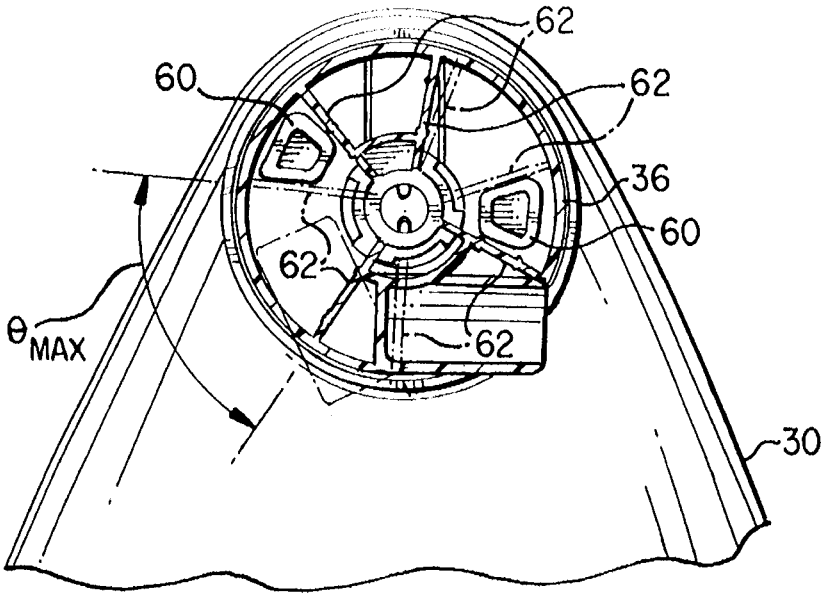
FIG. 6 is a sectional view of the right connector with the hub, showing the overrotation stops formed on the connector and the corresponding overrotation stop formed on the hub for limiting the swing amplitude of the swing carriage.
Figure 6A:
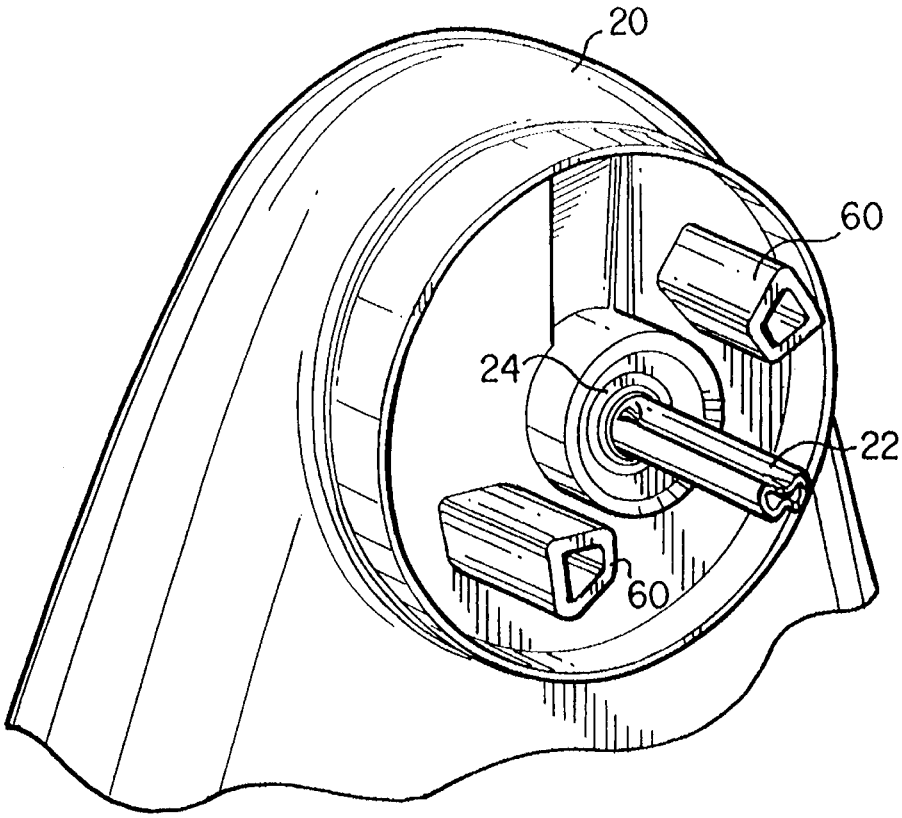
FIG. 6A is a perspective view of the left leg connector with its hub removed therefrom to show its pendulum axle and its overrotation stops for limiting the swing amplitude of the swing carriage.

According to the present invention, left and right hubs 26,36 are preferably connected to the left and right pendulum axles, respectively, with no relative rotational movement between the hubs and their axles. The left hanger is mounted to the left hub 26 and the right hanger to the right hub 36. As shown in FIGS. 4, 6 and 6A, each of the hubs preferably has means cooperating with their respective left and right leg connectors 20,30 for limiting the degree of rotation. Specifically, the limiting means comprises at least one overrotation stop 60, a pair of stops being preferable as shown in FIGS. 6 and 6A, extending laterally from each leg connector 20,30. The stops 60 cooperate with cooperating overrotation abutments or stops 62 formed on each of the hub 26,36 to prevent overrotation of the hubs relative to the connectors and thus the swing carriage. The maximum degree of rotation $\Theta_{MAX}$ between the abutments is about 70° or the swing amplitude of about 35° as schematically shown in FIG. 6.

A swing can generally be considered to behave as a simple pendulum when the amplitude is relatively small, where the period of oscillation is also generally unaffected by the mass of the pendulum. The swing amplitude is preferably between about 0° to 22° as presently contemplated by an embodiment of the present invention, which means that the period of oscillation for the swing is more or less can be considered to be substantially constant between these amplitudes. The velocity of the pendulum is greatest at its neutral position, i.e., swing amplitude of 0° and smallest at its peak amplitude (zero velocity) where it changes its direction. When the period is constant, a pendulum swinging at a bigger amplitude will have to travel at a greater velocity than the same swinging at a smaller amplitude. That is, a pendulum swinging at a bigger amplitude has to travel further during the same period and thus has to travel faster. In this regard, the drive mechanism needs to accommodate not only for variations of speed of the swing carriage, it must be synchronized with the swing cycle in order to achieve a natural swing motion.

The present invention contemplates a novel swing drive mechanism which operates in synchronism with the swing cycle regardless of the swing amplitude. Preferably, the present swing drive mechanism can selectively maintain two or more different levels of swing amplitude or swing speed, i.e., low, medium and high, for example. The swing drive mechanism 100 according to the present invention is shown in FIGS. 3–5 and 7–12. Although it is preferable to use an open top swing frame described above with the swing drive mechanism according to the present invention, any conventional swing frame can be used. The swing drive mechanism 100 comprises a drive sleeve 110 mounted coaxially and freely rotatably about the axle 32, a drive flange 120 is mounted substantially collinearly adjacent the drive sleeve on the axle with no relative rotational movement between the axle and the drive flange. A drive flange coupling device 130 is positioned between the drive sleeve and the drive flange, and a crank 150 driven by a motor 160 via a gear reduction train 155,156 is linked to the sleeve to oscillate the sleeve and thus the axle 32 via the coupling device and the drive flange.

Figure 12:
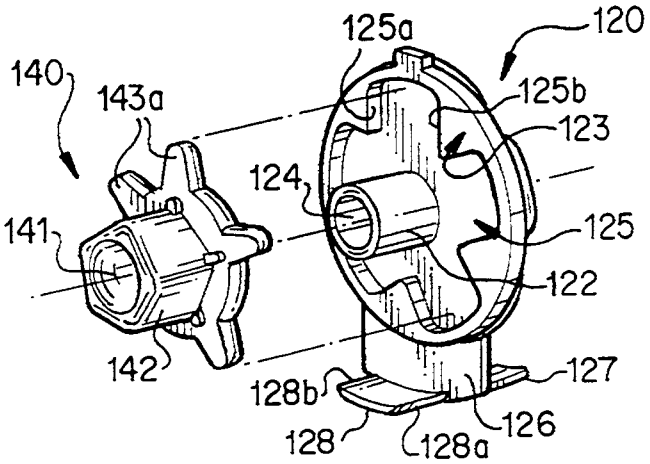
FIG. 12 is an exploded view of the drive flange and the drive coupling device arrangement, taken along line 12—12 of FIG. 11.
Figure 11:
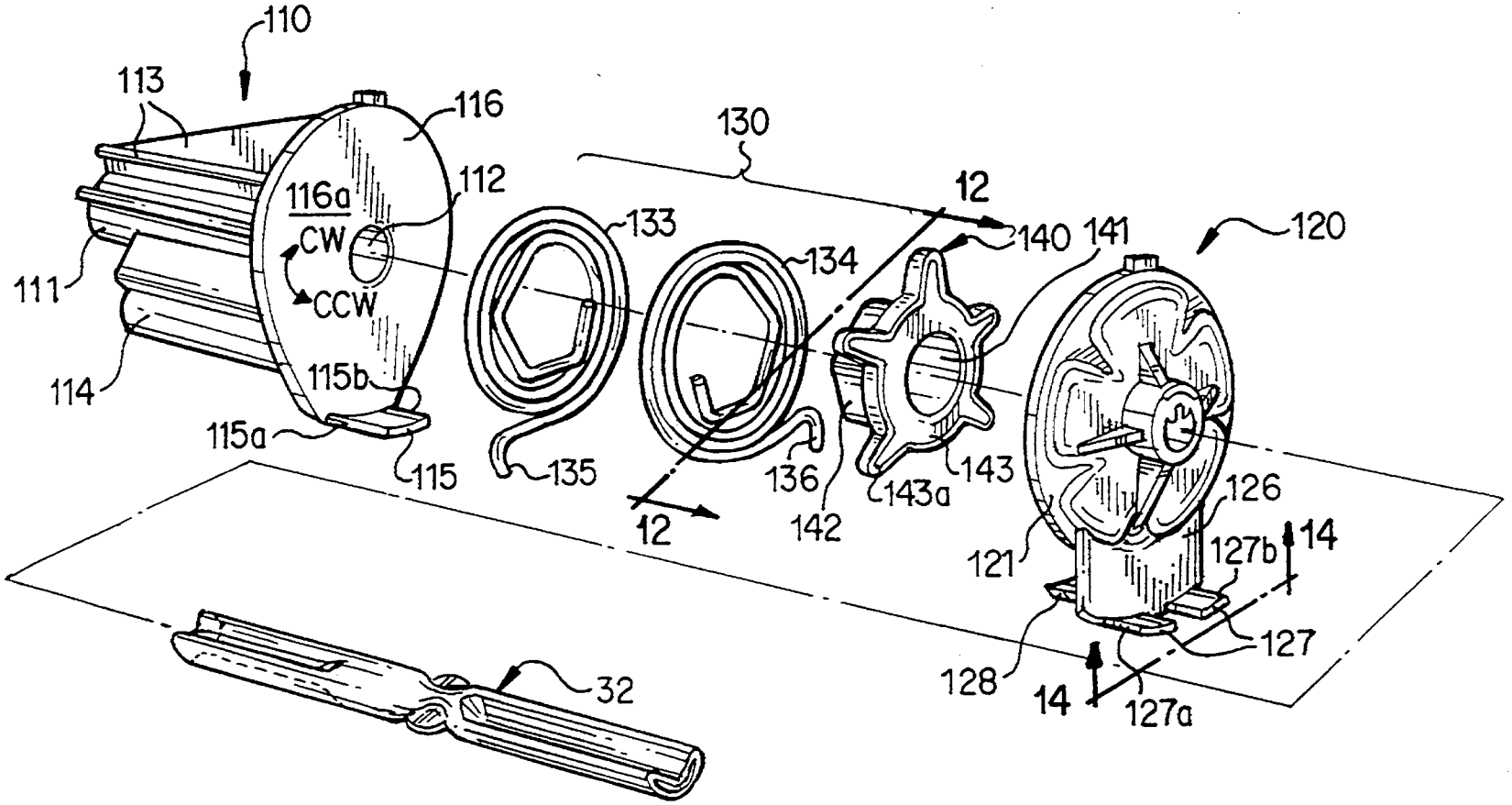
FIG. 11 is an exploded view of the drive mechanism arrangement, including the sleeve, the flange drive coupling device, the drive flange and the axle.

As better shown in FIGS. 11 and 12, the drive flange 120 comprises a disc member 121 with a central circular flange 122 extending collinearly therewith from the inner side or face 123 thereof. A central hole 124 extends through the flange and the disc member, which is provided with conventional means for limiting the rotational movement of the disc member relative to the axle, such as a non-circular hole, i.e., a square-shaped, D-shaped, V-shaped or crescent-shaped openings, etc., as shown in FIG. 11, which cooperates with a complementary shaped axle. The inner side 123 of the disc member is provided with a recess 125 having five symmetrical divisions, substantially akin to a propeller or five-leafed clover. Each of the five divisions has opposed abutment side walls 125*a*,125*b*.

The disc member 121 also has a radial extension 126 extending radially therefrom. An abutment 128 extends substantially perpendicularly from the free end of the extension 126. The abutment 128 also extends coaxially and circumferentially about the axle 32, parallel with the axle, and has two opposed abutment edges 128*a*,128*b* formed by the parallel edges thereof.

The coupling device 130 comprises a hub member 140 coaxially and rotatably mounted on the axle and at least one torsional spring 133,134 mounted coaxially on the hub member. Although the drawings show two discrete springs, a single continuous torsional spring attached to the hub member can also be used. The hub member has a central throughhole 141 slightly larger than the outer diameter of the flange 122 so that it coaxially engages thereover and freely rotates thereabout. The hub member preferably has a pentagonal central flange 142 collinearly arranged about a star-shaped disc 143 which has five symmetrical radial extensions 143*a*. Any non circular central flange can be used so long as it does not permit the spring to rotate thereabout. Each of the extensions 143*a* is substantially narrower than the distance between the abutment walls 125*a*,12*b* formed on each of the five divisions of the recess to enable the hub member to freely rotate relative to the drive flange 120, for example, of about 20°.

As shown in FIG. 11, two discrete torsional springs 133,134 of substantially equal spring constant are preferably positioned between the sleeve and the hub member and coaxially wrapped around the hub member in the opposite directions with no relative rotational movement between the hub member and the springs. Each of the springs has a substantially pentagonal central opening which corresponds to the pentagonal flange 142 of the hub member to enable the springs to be mounted coaxially thereon with no relative rotational movement. Each of the spring has a hook 135,136 facing toward each other for engaging with the sleeve. As previously indicated, a single spring attached to the hub member, for instance by way of a slot, with their ends capable of engaging the sleeve can also be used rather than two springs if desired.

The sleeve 110 comprises a substantially cylindrically shaped body 111 collinearly formed with a tear drop shaped plate member 116 having a planar outer face 116*a*, with a central throughhole 112 extending through the cylindrical body and the plate member. The throughhole 112 is dimensioned to enable the sleeve to freely rotate about the axle 32. The body 111 is preferably provided with a plurality of radially extending reinforcement ribs 113 and a channel 114 radially spaced from the axle and extending parallel with the cylindrical body.

The drive sleeve engages the springs via a spring engaging element 115 extending axially from the apex of the tear drop shaped plate member. The engaging element is axially and angularly aligned with the channel. The spring engaging element is also formed radially further away from the throughhole than the channel and can be aligned with the abutment 128. Two opposed abutment edges 115*a* and 115*b* are formed by the lateral edges of the spring engaging element 115. The distance between the abutment edges 115*a*,115*b* is preferably about same as that between the abutment edges 128*a*,128*b*, but smaller than the distance between the two hooks 135,136 such that the sleeve can freely move relative to the springs for a limited degree (providing a free play or lost motion relationship), which in turn translates to lost motion or free play relative to the axle 32. Specifically, unless the spring is already adjacent to one of the abutment portions 115*a*,115*b*, the sleeve has to rotate relative to the spring before it engages one of the springs and cause the hub member 140 to rotate and abut the drive flange 120.

The springs are arranged such that they engage opposed abutment edges of the abutments 115,128 and tend to cause the springs to coil tighter around the pentagonal central flange 142. Specifically, the two springs are coiled in the opposite directions such that rotation of the sleeve 110 in the clockwise direction (CW) causes the abutting edge 115*a* thereof to engage the hook 135 while causing the abutting edge 128*b* to engage the hook 136. Rotation of the sleeve in the counterclockwise direction (CCW) causes the abutting edge 115*b* thereof to engage the hook 136 while causing the abutting edge 128*a* to engage the hook 135.

The load required to oscillate the swing carriage at a relatively low amplitude, for instance of 10°, is generally relatively small. However, the energy required to oscillate increases by the square as the amplitude increases. In order to accommodate for varying loads, the present invention contemplates use of a spring or springs, in conjunction with the free play arrangement, to provide a plurality of spring gradients, three to be specific, to accommodate different swing heights. Specifically, the free play arrangement (where the relative differences between the width of the abutment 128 and the distance between the hooks 135,136) enables the sleeve to rotate freely relative to the spring. The free play provides the first gradient of zero load for a first predetermined angle of rotation. When the sleeve is rotated relative to the axle beyond the first predetermined angle of rotation in the same direction, one of the abutment edges 128*a*,128*b* is engaged with one of the hooks 135,136 and the other of the hooks 135,136 is engaged with one of the abutment edges 115*a*,115*b*, both springs being engaged such that they both become active. When the two springs are active, they provide a second gradient of load for a second predetermined angle of rotation. The second predetermined angle of rotation is preferably small relative to the first angle of rotation, which can begin when the load necessary to increase the swing amplitude increases relatively sharply to preferably parallel the load requirement for the corresponding swing amplitude. When the sleeve is rotated beyond the second predetermined angle of rotation in the same direction, the radial extensions 143*a* abut against one side of the side walls 125*a*,125*b*, preventing the hub member from rotating relative to the drive flange. When this happens, only one of the springs, the spring engaging the sleeve, becomes functional, which provides the third spring gradient which is substantially greater than the second spring gradient again to parallel the load requirement for a greater swing amplitude. In essence, if the spring constant between the two springs is equal, the third spring gradient would increase about two folds since only one of the two opposingly acting springs becomes active. These three spring gradients can provide the necessary load constants to operate a swing having variable swing amplitudes.

Referring to FIG. 4, the swing drive mechanism is housed in the right leg connector 30, but can just as easily be housed in the left leg connector 20. The axle 32 is rotatably journaled to the connector 30 to enable the axle to pivot or oscillate to cause the hub 36 to rotate along with the axle to thereby oscillate the hanger connected thereto. According to the present invention, the sleeve is caused to oscillate using a crank 150 which is driven preferably by a DC motor 160. As previously indicated, it is desirable to prevent the motor from straining or seizing when the seat is stopped from swinging, intentionally or otherwise while the motor is running. The torsional springs 133,134 in conjunction with lost motion arrangement (of the sleeve relative to the axle) can absorb the energy input by the motor in the event the swing carriage is stopped while the motor is running or in the event the motor is stopped while the swing carriage is in motion. During the interim when the lost motion is operational, the sleeve is basically decoupled from the axle and thus from the swing carriage. In this regard, the free play or the lost motion arrangement can enable the axle to oscillate less than the amplitude driven by the crank, as will be explained from below.

The crank 150 basically rotates about an axis 151 that is perpendicular to the axle. The crank has a driven portion 152 that is offset from and parallel to the axis 151 of rotation of the crank. Rotation of the crank thus causes its offset driven portion to follow a circular orbit whose radius R is the distance of the offset. In this regard, the radius of the offset should be such that the orbiting crank oscillates the sleeve at a greater amplitude than the greatest desired oscillation (third amplitude).

The offset drive portion 152 preferably has a ball 153 that is rotatable about the driven portion, the ball being slideably mounted in the channel such that rotation of the crank enables the sleeve to oscillate about the axle while the ball slideably oscillates back and forth within the channel. To properly track the ball within the channel, the length of the channel should be same or longer than the diameter of the orbiting ball. Means other than the ball, such as a cylinder, universal pivot or flexible link can be attached to the driven portion to enable transfer of orbiting motion to oscillatory motion.

Figure 5:
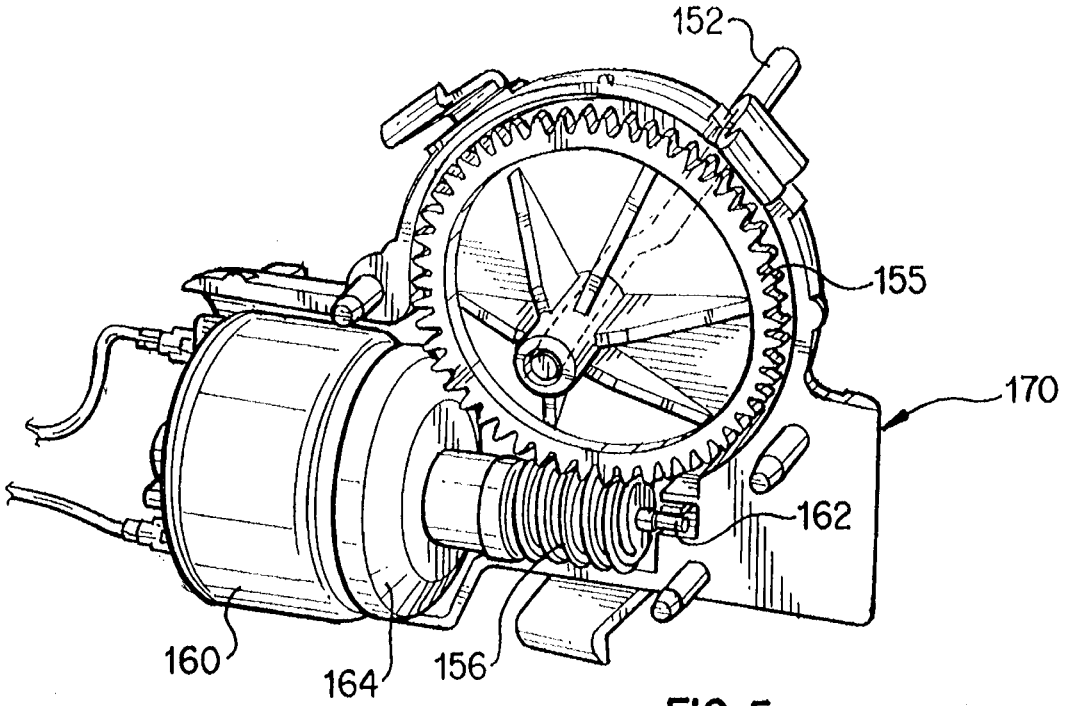
FIG. 5 shows the details of the motor and the crank.

As shown in FIG. 5, the crank is fixedly connected to a drive train which includes a driving gear 155 engaged to a worm shaft 156 which is connected to an output shaft 162 of the motor 160. The output shaft 162 is mounted substantially perpendicular to the axle, and the crank rotates about the axis 151 that is perpendicular to the output shaft 162 and the axle 32. Preferably, the motor has a flywheel 164 connected to the output shaft 162 to even the varying load (encountered during the swing cycle) applied to the motor. The motor and the crank are preferably housed in a motor housing 170 which is non-displaceably connected to the connector 30. The crank and the motor rotate about their axes of rotation which does not change relative to each other, to the axle 32 or to the connector 30.

FIGS. 7–10 show the schematic position of the crank in relationship to the sleeve. FIGS. 7A, 8A, 9A and 10A are views taken along the line A—A of FIG. 3, with the drive flange 120, the hub member 140 and the springs 133,134 omitted for convenience of illustration. FIGS. 7B, 8B, 9B and 10B are views similar to FIG. 4, but showing only the motor housing 170, including the motor 160 and the crank 150, and a section of the channel 114 formed on the sleeve 110. As seen from arrows W, the crank rotates in one direction.

Figure 15:
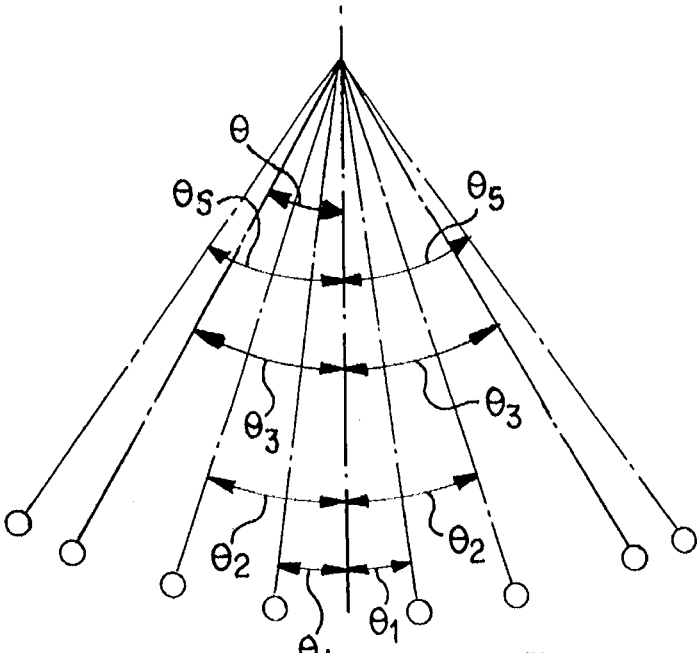
FIG. 15 is a schematic representative of a pendulum.
Figure 7A:
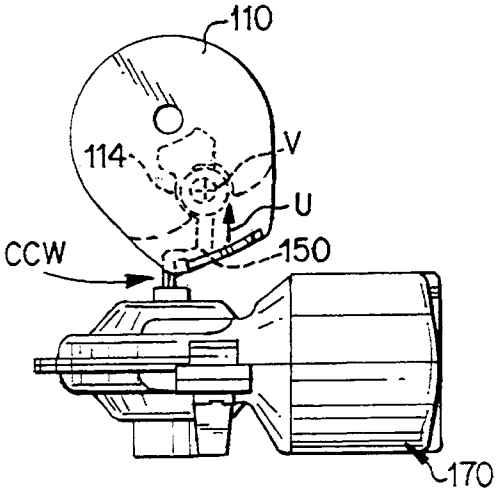
Figure 7B:
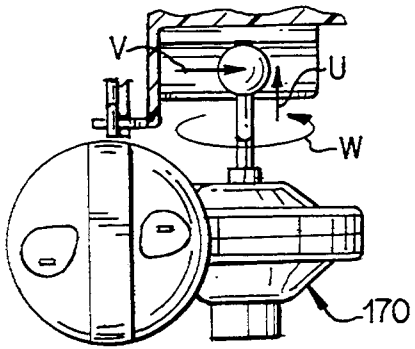

FIGS. 7A and 7B show the instance where the sleeve has rotated counter-clockwise (CCW) and reached its maximum amplitude $\Theta_1$, $\Theta_2$, or $\Theta_3$ as shown in FIG. 15. At this instance, the force vector V output by the crank is substantially parallel to the axis of rotation of the sleeve, thus imparting no oscillatory motion. The sleeve is moving at zero velocity and changing its direction of rotation. As seen from FIG. 7B, the offset driven portion 152 is positioned about the midpoint of the channel, with the ball 153 slid up relative thereto as shown by the arrow U.

Figure 8A:
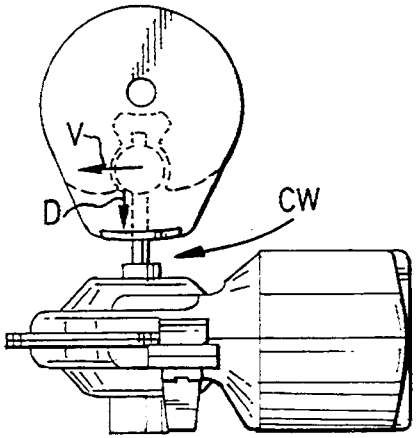
Figure 8B:
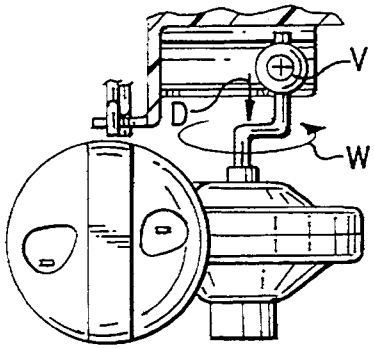

FIGS. 8A and 8B show the instance where the crank has rotated 90° relative to the crank positioned in FIGS. 7A and 7B, respectively, causing the sleeve to rotate in the opposite direction. At this instance, the sleeve is rotating in the clockwise (CW) direction at its maximum velocity, with the ball slid down as shown by arrow D to its lowest point relative to the offset driven portion. At this instance, the force vector V output by the crank is perpendicular to the axis of rotation of the sleeve, where the velocity of the rotating sleeve is substantially equal to the orbiting velocity of the crank. As shown in FIG. 8B, the offset driven portion is at its rightmost point on the channel.

Figure 9A:
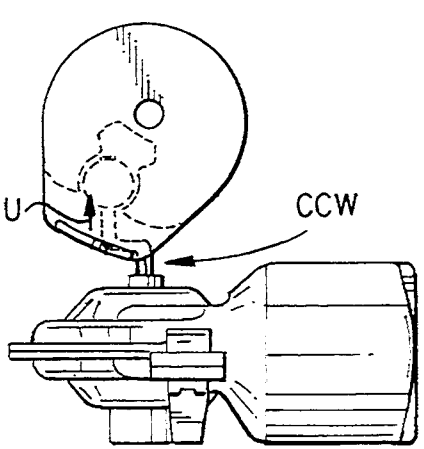
FIGS. 7A,7B, 8A,8B, 9A,9B and 10A,10B show the operation of the swing drive mechanism and the relative position of the crank relative to the sleeve member.
Figure 9B:
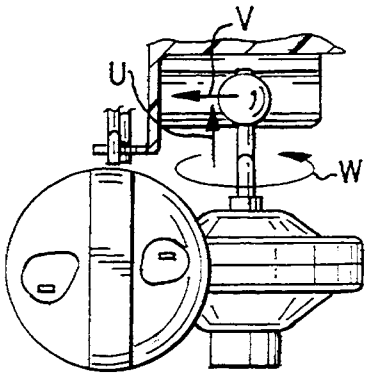

FIGS. 9A and 9B show the instance where the crank has rotated about 90° relative to the crank positioned in FIGS. 8A and 8B, respectively. In this instance, the sleeve has rotated clockwise (CW) and reached its maximum amplitude $\Theta_1$, $\Theta_2$, or $\Theta_3$. Again, the force vector V output by the crank is parallel to the axis of rotation of the sleeve at this point. Thus, the sleeve is moving at zero velocity and changing its direction of rotation. As seen from FIG. 9B, the offset driven portion is positioned about the midpoint of the channel, with the ball slid up relative thereto as shown by the arrow U.

Figure 10A:
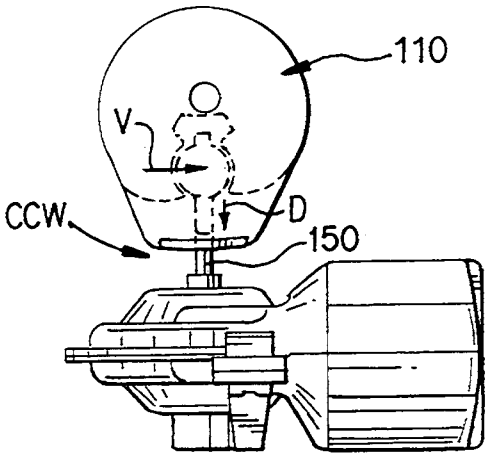
Figure 10B:
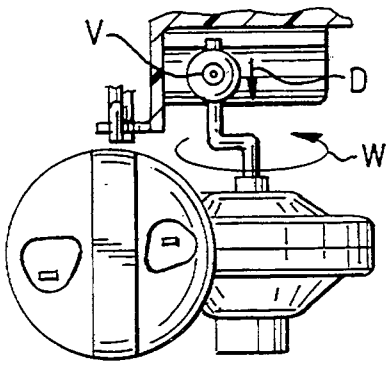

FIGS. 10A and 10B show the instance where the crank has rotated about 90° relative to the crank positioned in FIGS. 9A and 9B, respectively, causing the sleeve to rotate in the opposite direction. At this instance, the sleeve is rotating in the clockwise (CCW) direction at its maximum velocity, with the ball moved down as shown by the arrow D to its lowest point relative to the offset driven portion. Again, the force vector V output by the crank is perpendicular to the axis of rotation of the sleeve, where the velocity of the rotating sleeve is substantially equal to the orbiting velocity of the crank. As shown in FIG. 10B, the offset driven portion is at its leftmost point on the channel.

It was already described that the velocity of the pendulum is greatest at its neutral position, i.e., swing amplitude of 0° and zero at its peak amplitude where it changes its direction. The sleeve/crank arrangement according to the present invention substantially mimics the pendulum motion, where the velocity of the oscillating sleeve is greatest where its amplitude is at 0° and zero at its maximum amplitude where the direction of rotation changes.

The drive mechanism according to the present invention accommodates not only for variations of speed of the swing carriage to achieve a natural swing motion. This is achieved by using the above described crank/sleeve arrangement in conjunction with the above described drive flange coupling device 130 which has three different spring gradients or constants. Specifically, the oscillation amplitude of the sleeve will remain substantially constant at $\Theta_S$ as schematically represented in FIG. 15, generally limited by the orbit diameter of the driven portion. However, due to the lost motion or free play arrangement described above in conjunction with the springs, the axle does not need to oscillate the same amount. Depending on the amount of torque output by the motor, the axle can always be controllably driven less than the oscillation amplitude of the sleeve.

Specifically, the crank can be tuned to oscillate the sleeve at a period substantially equal to the natural oscillation period of the swing carriage to synchronize the sleeve with the oscillation of the swing carriage. With reference to FIG. 15, if the torque applied to the motor is such that the swing carriage can only oscillate a fraction of the oscillation amplitude, at $\Theta_1$ for instance, the lost motion arrangement can enable the sleeve to oscillate to $\Theta_S$. Since the period of oscillation is the same for the sleeve and the swing carriage, the sleeve will remain synchronized with the swing carriage. Any small synchronizing discrepancy occurring between the sleeve and the swing carriage due to mechanical aberration can be absorbed by the loss motion arrangement and the springs to maintain proper synchronization.

The swing mechanism described above can be used with any conventional swing control. For instance, to provide two different amplitudes, low and high, one can provide a control that outputs two different voltages depending on the swing height selected. Upon selection of the low amplitude setting, a low voltage can be input to the motor. Upon selection of the high amplitude setting, a relatively higher voltage can be input to the motor. Preferably, the motor operates substantially at a constant speed regardless of the voltage input to the motor. By inputting higher voltage, the motor will impart a greater torque to cause the axle to oscillate at a relatively greater amplitude.

Another aspect according to the present invention is a unique swing height or amplitude control 200 which can be used with the swing drive mechanism described above or with any conventional swing. According to the present invention, the swing control incorporates means for detecting the swing height or amplitude, which can be any conventional switches which can be triggered by any element that oscillates with the seat such as the hanger or the pendulum axle.

The swing control 200 according to the present invention, can provide three swing height or speed settings (first, second, and third), where the first setting is smallest, the third setting the largest and the second setting falling between the first and second settings. The swing control can selectively output either zero voltage, a first predetermined voltage, a second predetermined voltage or a third predetermined voltage to selectively control the voltage input to the motor based on the swing height or speed selected and the sensed swing height to achieve the desired swing height. The first, second and third voltages are greater than zero, with the first voltage being the smallest and the third being the greatest, with the intermediary second voltage falling between first and second voltages.

Figure 14:
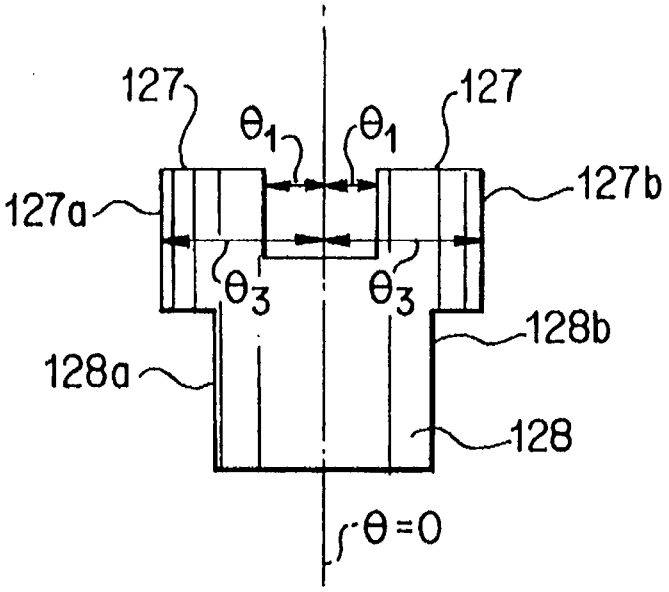
FIG. 14 is a schematic elevational bottom view of the prongs taken along line 14—14 of FIG. 11.

According to the present invention, the swing height detection means shown in the preferred embodiment comprises a swing angle indicator formed on the drive flange 120 and a light interrupt detector 210. As shown in FIGS. 11 and 14, the angle indicator comprises a pair of spaced apart prongs 127 extending substantially perpendicularly from the free end of the extension 126. The prongs 127 extend coaxially and circumferentially about the axle 32, parallel with the axle, in the direction opposite the abutment 128. The dimensions of the two prongs are substantially the same, with the spacing between the prongs being about the width of one of the prongs. The prongs operate in conjunction with a light interrupt indicator 210 to determine the angle of rotation of the axle relative to the connector.

Figure 13:
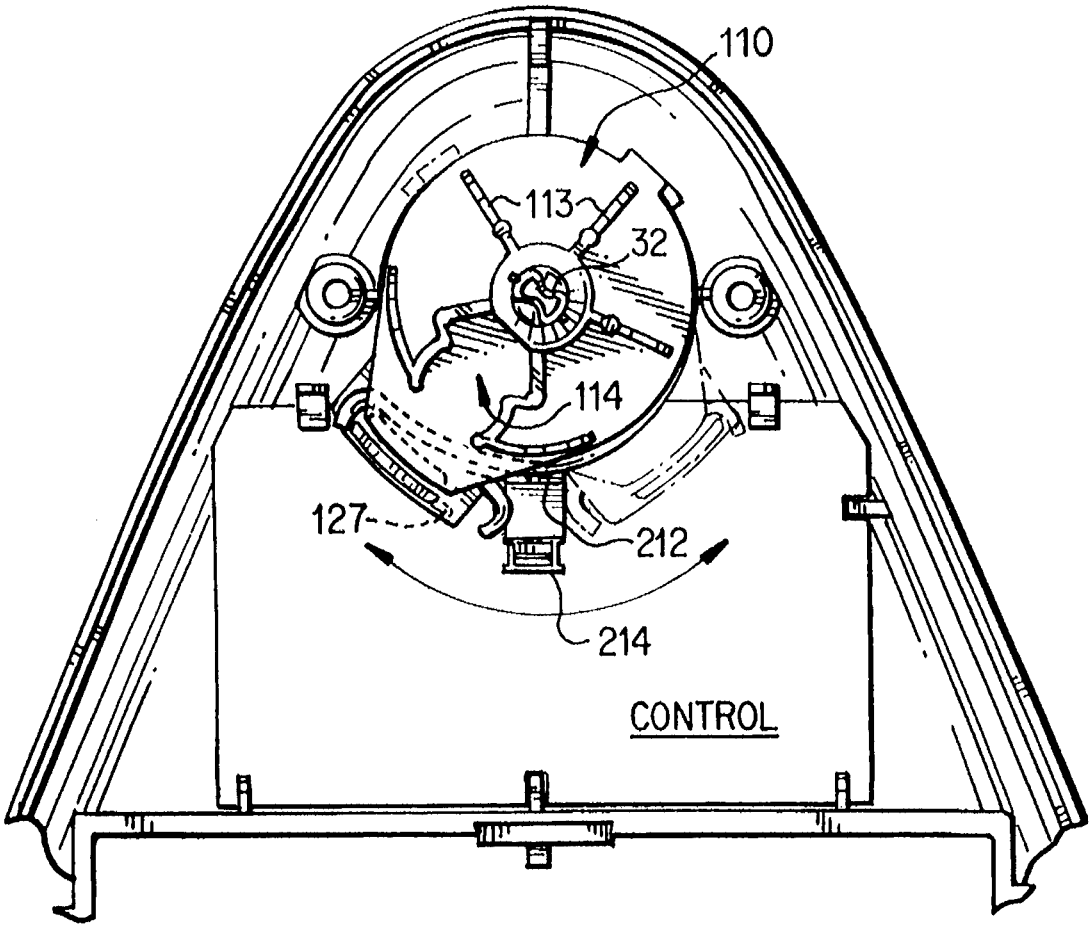
FIG. 13 is sectional view taken along line 13—13 of FIG. 4, showing the drive flange and a swing position detector.

The light interrupt detector 210 comprises a photodetector or phototransistor 212 aligned with and spaced apart from an infrared light emitting diode (IRLED) 214. Since the drive flange is non-rotatably connected to the axle, the prongs rotate along with the axle 32. As shown in FIGS. 4 and 13, the light interrupt detector is positioned so that the prongs can oscillate between the photodetector and the IRLED. As the prongs oscillate, they can interrupt or block light emitting from the IRLED to the photodetector, representative of the swing amplitude exceeding a predetermined setting. The prongs and spacing therebetween are dimensioned such that they can indicate at least three different patterns of light interruption to detect the swing amplitude. Specifically, when the oscillation occurs between the prongs (within the spacing between the prongs), light emitting from the IRLED is not interrupted. In this mode, the swing height is within the first swing height setting. When the oscillation is greater such that the prongs do interrupt light emitting from the IRLED, the swing is oscillating within the second or third swing height setting. When the oscillation occurs even at a greater angle, the prongs interrupt light emitting from the IRLED as in the second swing height setting, but the prongs can swing past its extreme outer edges 127*a*,127*b*, which at that point ends the light interruption (within the same period). In this mode, the swing oscillates past the third swing height setting.

Depending on the amplitude of the swing, the prongs either interrupt or do not interrupt light emitted by the IRLED. When the swing is centered (at its neutral position), the amplitude $\Theta$ is at 0° as shown by schematic representations in FIGS. 14 and 15. The prongs can be dimensioned, for instance, so that the amplitude at $\Theta_1$ is about 9° and at $\Theta_3$ is about 22°. The prongs do not interrupt light emitted by the IRLED until the prongs rotate either direction from the center by an amplitude of about 9°. From the amplitude of about 9° to the amplitude of about 22°, the prongs interrupt light emitting from the IRLED. When the prongs rotate beyond about 22° amplitude, the light becomes uninterrupted.

Figure 16:
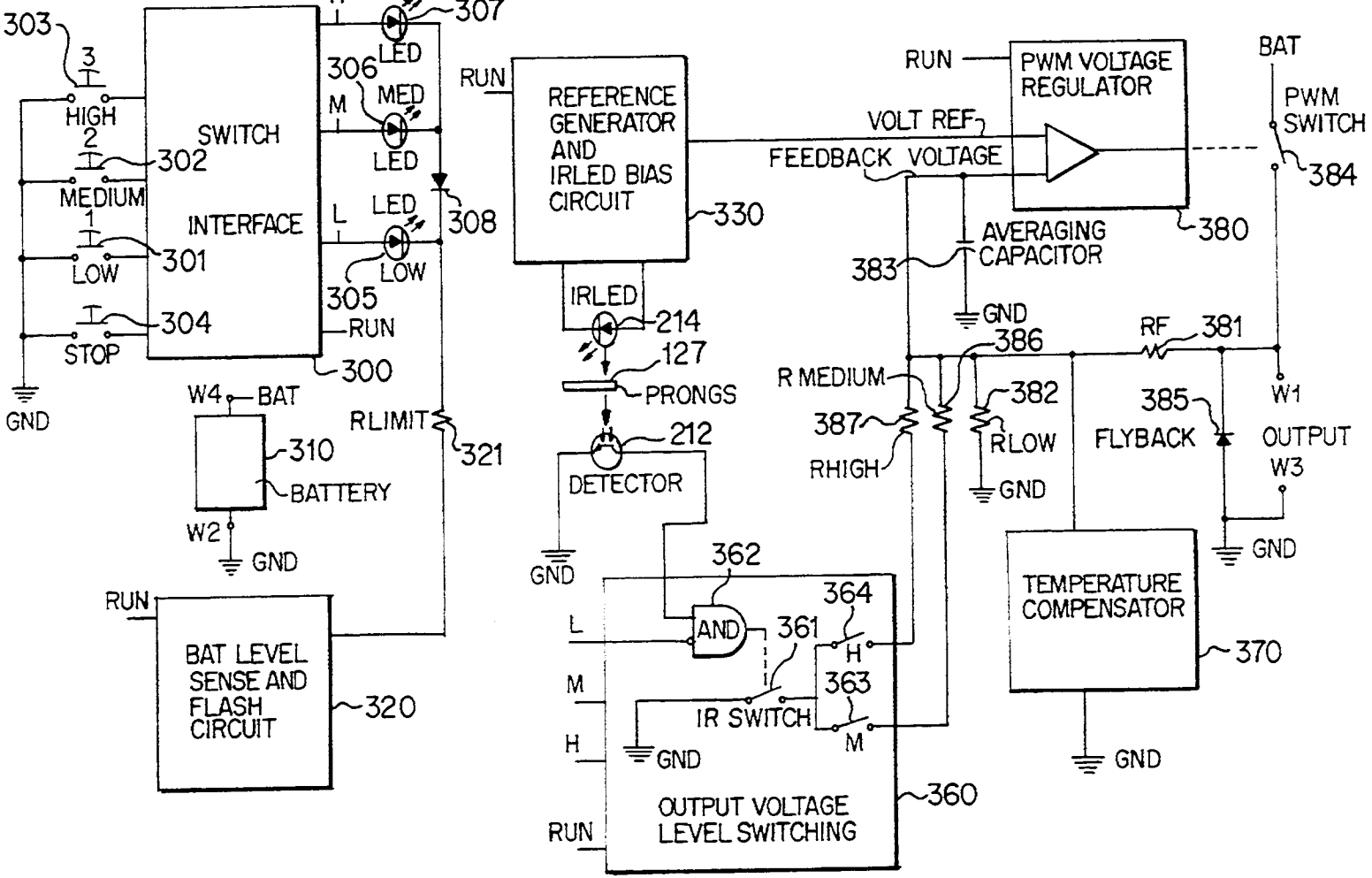
FIG. 16 shows one embodiment of the controls for the swing drive mechanism.
Figure 17:
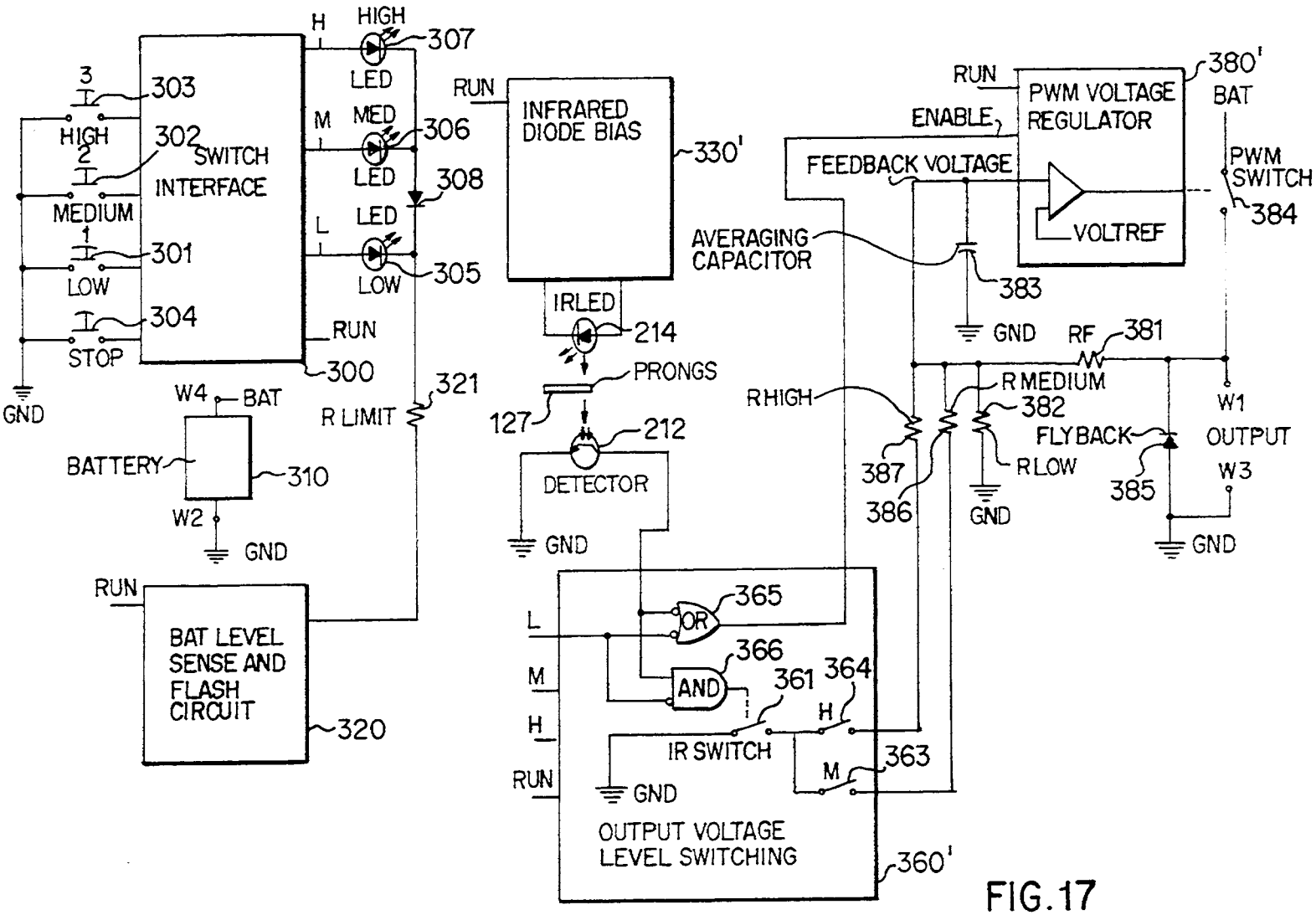
FIG. 17 shows another embodiment of the controls for the swing drive mechanism.

FIGS. 16 and 17 show schematic representative block diagrams of different embodiments of the control according to the present invention which can selectively produce a plurality of different voltages which can be applied to the motor in order to produce three different swing amplitudes. For convenience, the same or equivalent elements have been identified with the same reference numerals. The amplitudes are referred to as low (first), medium (second) and high (third), which are actuated by switches, preferably pushbuttons 301, 302, and 303, respectively. A stop switch, preferably pushbutton 304 is provided for turning off the control.

According to the preferred embodiment, a switch interface 300 is provided between the switches LOW 301, MED 302, HIGH 303 and STOP 304 and their respective LOW LED 305, MED LED 306 and HIGH LED 307. The interface can include a conventional circuitry which remembers the last switch depressed, such as a non-clocked flip-flop(s). The control can include a power on switch. However, since such an interface typically uses an insignificant amount of power, it can remained powered to eliminate the need for a separate power on switch. When any one of the switches 301, 302 and 302 is turned on, a digital RUN output signal 309 and the corresponding "L", "M", or "H" digital signal become high. These digital signals then control other control elements. Specifically, the run output enables power to be supplied to the control elements or circuitry 320, 330, 330', 360 (360') and 380, 380'. When the STOP switch is pushed, the RUN output becomes disabled or turned low to shut off the control. Any switch can be activated at any time regardless of the previous selection.

The "H" and "M" outputs can be connected to two opposite outputs of a flip-flop to make them complements of each other. Accordingly, whenever "H" output from the switch interface box 300 becomes high, the "M" output will be low and vice-versa. When either the HIGH or MED switch is activated, the "L" output becomes low, for instance, by grounding the "L" output signal, to cause the LED bias current to flow through resistor RLIMIT 321 and light the HIGH or MED LED. On the other hand, whenever the LOW switch is activated, the "L" output becomes high, regardless whether the "H" or "M" output is high and the diode 308 in series with the MED or HIGH LED will cause all the biasing current to be shunted through the LOW LED 307. The "H" or "M" output can remain high as this signal will have no effect on the voltage output when the LOW switch is turned on.

Whenever any one of the LOW, MED and HIGH switch is activated, the RUN output becomes high and a predetermined reference voltage (PRV) can be generated by the reference generator 330 and applied to the voltage regulator 380 as shown in the embodiment of FIG. 16. Alternatively, the voltage regulator can produce its own reference voltage as shown in the embodiment of FIG. 17. In addition, the reference generator 330 and the IRLED bias circuit 330' produce the necessary bias voltage for the IRLED 214.

When the RUN output is high, the pulse-width modulation (PWM) circuitry or switch 384 becomes active. A resistor divider network comprising RF 381 and RLOW 382 can provide a percentage of output voltage as a feedback value to the voltage regulator 380. Whenever the feedback value is less than the PRV, the PWM switch 384 is closed. This causes the averaging capacitor 383 voltage to rise until the feedback voltage value becomes greater than the PRV (plus a small amount of hysteresis). At this point, the PWM switch 384 opens and the capacitor voltage decays. When the capacitor voltage decays down to the PRV (minus a small amount of hysteresis), the PWM switch 384 is closed once again, repeating the process to maintain the average value of the feedback voltage to equal the PRV. The output voltage to the motor is controlled by resistors RLOW 382, RMEDIUM 386, RHIGH 387 and RF 381 since the feedback voltage represents a fixed percentage of the output.

It is important to note that because the motor acts as an inductive load, when the PWM switch is opened, current still flows into the motor. The flyback diode 385 can be used to provide a path for this current and clamp the output voltage to a diode voltage, typically 0.5 to 0.7 V below ground.

With respect to the embodiment shown in FIG. 16, when the LOW switch 301 is activated, the "L" signal becomes high and the AND gate 362 will always output a low signal. Accordingly, the IR switch 361 will always be held open by the AND gate 362 when the LOW switch is activated, and the feedback percentage, as described above, can be defined solely by the RLOW 382 and the RF 381. This is true for the low swing amplitude setting regardless of the position of the prong 127 or the values of the "M" or "H" signal output to the output voltage level switching circuit 360. Alternatively, as shown in FIG. 17, the output voltage level switching 360' can cut-off the voltage upon the prongs 127 interrupting light emitting from the IRLED. In this embodiment, an OR gate 365 can be used to selectively provide high or low ENABLE signal to the voltage regulator 380'. Specifically, when the "L" signal is high and the prongs do not block light emitting from the IRLED, the OR gate will always produce high ENABLE signal. However, when the prongs do block light emitting from the IRLED, the OR gate will produce a low ENABLE signal to disable the voltage regulator, providing no voltage output to the motor. The values of the RLOW and the RF thus can be selected to provide the desired low or first output voltage to the motor.

When the MEDIUM switch 302 is activated, the "M" output goes high, the "M" switch 363 is closed and the "L" input to the inverter of the AND gate 362 becomes low. The IR switch 361 is closed only when the photodetector 212 outputs high signal, i.e., interruption of light emitting from the IRLED. Accordingly, the voltage output to the motor will be controlled by the RLOW 382 and the RF 381 as in the LOW mode. Alternatively, with respect to FIG. 17, the low "L" signal is output to the inverters of the OR gate 365 and the AND gate 366, while either high or low signal from the photodetector 212 is input to the AND gate 366 and the inverter of the OR gate 365. Since the "L" signal will always be low in this mode, the OR gate will always output a high ENABLE signal and always enable the voltage regulator. Again, the IR switch will close only when the photodetector outputs high signal (upon interruption of the light). When the IR switch 361 is closed, the RMEDIUM 386 is connected in parallel with the RLOW 382, lowering the overall resistor value and thus the feedback percentage to raise the voltage output to the motor to the selected medium voltage level. The value of the RMEDIUM thus can be selected to provide the desired medium or second output voltage to the motor.

The operation of the HIGH mode is substantially similar as the MEDIUM mode. Specifically, when the HIGH switch 303 is activated, the "H" signal goes high and the "L" signal goes low. The IR switch 361 is closed only when the photodetector outputs high signal upon the prongs interrupting the light. However, when the IR switch 361 is closed, the RHIGH 387 is connected in parallel with the RLOW 382. The value of the RHIGH can be selected to provide the desired high or third output voltage to the motor. Alternatively, the "M" switch 363 can be closed along with the "high" switch to connect the RHIGH, the RMEDIUM and the RLOW in parallel. In this regard, a higher value RHIGH can be used to provide the same high or third output voltage to the motor.

In the medium and high swing settings, whenever the IRLED light is not interrupted such that the photodetector outputs a high signal, the IR switch 361 is opened or remains opened, preventing both the RMEDIUM and the RHIGH from being connected in parallel with the RLOW. This forces the output voltage to its low value regardless of the position of the "M" switch 363 or the "H" switch 364.

The PRV generated by the reference generator 330 can be produced for example by a semiconductor diode, which typically has a negative temperature coefficient of about −2 millivolt/°C. Thus, as the temperature increases, the reference output voltage from the semiconductor diode falls. Accordingly, when such a semiconductor diode is used, it is desirable to provide a temperature compensator 370 such as a negative coefficient thermistor connected in parallel with the RLOW 382 to compensate for the drop in reference voltage. As the temperature increases, the thermistor resistance decreases, thereby decreasing the percentage of feedback. This action increases the output voltage with increasing temperature and thus compensates for the fall of the reference voltage. Alternatively, as shown in FIG. 17, a temperature compensator can be built into the voltage regulator 380' which produces its own internally temperature compensated reference voltage VOLT REF.

Preferably, the battery sense and flash circuit 320 can be used to cause at least one of the indicator LEDs 305, 306, or 307 to flash when the battery voltage supply falls below a predetermined voltage level to provide a visual indication of when the batteries need to be replaced.

As described above, the exemplary controls shown in FIGS. 16 and 17 can be used to produce three different output voltages to the motor depending upon the swing amplitude selected by the user. However, modifications can be made to the control shown in FIGS. 16 and 17 to achieve the same functional attributes. For example, the pulse-width modulation scheme for voltage regulation may be replaced by a linear voltage regulator if desired. These changes are well within the ambit of one skilled in the art and is deemed to be within the scope of this invention.

In operation, upon selection of the first swing height or speed setting, the control outputs the first voltage to the motor regardless of the swing height detected. However, in the event that the swing height exceeds the first predetermined swing height setting of, for example, greater than 9°, it is preferable for the control to cut-off the voltage applied to the motor for the duration of the portion of the swing that exceeds the first swing height setting.

Preferably, the first voltage is sufficient to enable the swing carriage to reach about 12°, a little beyond the first swing height setting to enable the prongs to interrupt light emitting from the IRLED.

If the second swing amplitude setting is selected, again the control outputs the first voltage to the motor until the swing height exceeds the first swing height setting of about 9°. Upon the swing height exceeding the first swing height setting, the control outputs the second voltage to the motor for the duration of the portion of the swing that exceeds the first swing height setting. In the second swing amplitude setting, the control outputs the second voltage which would enable the swing carriage to reach greater than 12°, for instance.

If the third swing height setting is selected, again the control outputs the first voltage to the motor until the swing height exceeds the first swing height setting of 9°. Upon the swing height exceeding the first swing height setting, the control outputs the third voltage to the motor for the duration of the portion of the swing that exceeds the first swing height setting. The third voltage enables the swing carriage to reach greater than the second setting, but preferably less than 22° for instance.

In the second and third swing mode, however, when and if the swing height exceeds 22°, light emitting from the IRLED is again uninterrupted, causing the control to output the first voltage to the motor for the duration of the portion of the swing height that exceeds the third swing height setting to prevent excessively high swing amplitude. It should be noted that this can apply to the first mode. However, since the voltage supplied to the motor can be cut-off when the amplitude exceeds 9°, it will generally not occur, but adds additional protection, however.

Given the disclosure of the present invention, one versed in the art would readily appreciate the fact that there can be many other embodiments and modifications that are well within the scope and spirit of the disclosure set forth herein, but not specifically depicted and described. For example, although the present invention relates to a swing construction for an infant or child, the same teaching and principle may be applied to swings that handle a lighter object such as a doll, as well as for a heavier person such as an adult. Accordingly, all expedient modifications readily attainable by one versed in the art from the disclosure set forth herein that are within the scope and spirit of the present invention are to be included as further embodiments of the present invention. Accordingly, the scope of the present invention is to be as set forth in the appended claims.

What is claimed is:

1. A swing assembly comprising:

a seat;

at least one hanger connected to said seat;

a support frame supporting said hanger; and a swing drive mechanism mounted on said support frame for oscillating said hanger relative to said support frame, said swing drive mechanism comprising:

an axle mounted on said support frame, wherein said hanger is operatively connected to said axle;

a drive sleeve mounted coaxially and rotatably about said axle, wherein said sleeve is rotatable relative to said axle;

a drive flange mounted on said axle;

a drive flange coupling device positioned between said drive sleeve and said drive flange to cause said axle to oscillate with said drive sleeve;

a crank linked to said sleeve for oscillating said sleeve; and a motor for rotating said crank.

2. A swing assembly according to claim 1, wherein said coupling device comprises at least one spring mounted coaxially and rotatably relative to said axle and collinearly adjacent relative to said sleeve, wherein said spring is positioned to enable engagement with said sleeve.

3. A swing assembly according to claim 2, wherein said coupling device further comprises a hub member rotatably mounted on said axle, wherein said spring is coaxially mounted to said hub member, said hub member including abutments for engaging with said drive flange, whereby torque applied to said sleeve is transferred to said spring which causes said hub member to rotate and cause said abutments to engage said drive flange and transfer to said axle.

4. A swing assembly according to claim 3, wherein said sleeve includes a channel running parallel with said axle and said crank has a ball mounted thereon, said ball being mounted in said channel and slideable and relative thereto, said ball being slideably movable and rotatable relative to said crank, whereupon rotation of said crank causes said sleeve to oscillate about said axle and along with said axle.

5. A swing assembly according to claim 4, wherein said motor has an output shaft mounted substantially perpendicular to said axle and said crank rotates about an axis that is perpendicular to said output shaft and said axle.

6. A swing assembly according to claim 1, further comprising a control for changing the swing amplitude.

7. A swing assembly according to claim 6, wherein said control has means for selectively providing at least two different predetermined swing amplitudes.

8. A swing assembly according to claim 7, wherein said control has means for selectively providing three different predetermined swing amplitudes.

9. A swing assembly according to claim 8, wherein said control has means for detecting the swing amplitude.

10. A swing assembly according to claim 9, wherein said control has means for controlling the swing amplitude based on the amplitude detected and the amplitude selected.

11. An open top swing comprising:

a seat;

a pair of hangers connected to said seat;

a free standing support frame pivotally supporting said hanger, said support frame comprising:

a rear base;

first and second opposed legs extending upwardly at an angle from ends of said rear base;

a front base;

third and fourth opposed legs extending upwardly at an angle from ends of said front base, wherein said first and third legs converge toward each other, and said second and fourth legs converge toward each other;

a first connector attached to said first and third legs for maintaining said first and third legs at a fixed position relative to each other;

a second connector attached to said second and fourth legs for maintaining said second and fourth legs at a fixed position relative to each other;

a first axle journaled for rotation on said first connector;

a second axle journaled for rotation on said second connector;

a hub mounted to each of said first and second axles, wherein one of said hangers is mounted to one of the hubs and the other of said hangers mounted to the other of said hubs; and a swing drive mechanism mounted on said one of said first and second connector and operatively connected to respective one of said first and second axle for oscillating said seat, wherein said swing drive mechanism has means for selectively controlling the degree of rotation of said first and second axles.

12. An open top swing according to claim 11, wherein said front base is substantially trapezoidal shaped, defined by a median arm and a pair of oppositely extending arms extending from ends of said medial arm, wherein said third and fourth legs extend from ends of said oppositely extending arms.

13. An open top swing according to claim 12, wherein said median arm is substantially parallel to said rear base and extends rearwardly toward said rear base.

14. An open top swing according to claim 11, further comprising an overrotation stop mounted to each of said hubs and a cooperating overrotation stop mounted to each of said first and second connectors adjacent each of said hubs, wherein said stop and said cooperating stop prevent over-rotation of said hubs relative to the first and second connectors.

15. An open top swing according to claim 11, wherein said swing drive mechanism has control means for selectively providing at least two different predetermined swing amplitudes.

16. An open top swing according to claim 15, wherein said control means selectively provides three different predetermined swing amplitudes.

17. An open top swing according to claim 16, wherein said control means includes means for detecting the swing amplitude and controls the swing amplitude based on the amplitude detected and the amplitude selected.

18. An open top swing according to claim 17, wherein said swing drive mechanism comprises:

a drive sleeve mounted coaxially and rotatably about said one axle connected to said one connector mounting said swing drive mechanism, wherein said sleeve is rotatable relative to said one axle;

a drive flange mounted on said one axle to provide a limited degree of rotation of said sleeve relative to said axle;

a crank linked to said sleeve for oscillating said sleeve; and a motor fixedly connected relative to said one connector and operatively connected to said crank for rotating said crank, wherein said sleeve converts rotary motion to oscillatory motion to thereby oscillate said one axle and thus said one hub, thereby oscillating said seat via said hangers.

19. An open top swing according to claim 18, further comprising a drive flange coupling device positioned between said drive sleeve and said drive flange to cause said axle to oscillate with said drive sleeve.

20. An open top swing according to claim 19, wherein said coupling device comprises at least one spring mounted coaxially and rotatably relative to said axle and collinearly adjacent relative to said sleeve, wherein said spring is positioned to enable engagement with said sleeve.

21. An open top swing according to claim 20, wherein said coupling device further comprises a hub member rotatably mounted on said axle, wherein said spring is coaxially mounted to said hub member, said hub member including abutments for engaging with said drive flange, whereby torque applied to said sleeve is transferred to said spring which causes said hub member to rotate and cause said abutments to engage said drive flange and transfer to said axle.

22. An open top swing according to claim 21, wherein said sleeve includes a channel running parallel with said axle and said crank has a ball mounted thereon, said ball being mounted in said channel and slideable and relative thereto, said ball being slideably movable and rotatable relative to said crank, whereupon rotation of said crank causes said sleeve to oscillate about said axle and along with said axle.

23. A swing drive mechanism adapted for a swing that includes a supporting frame and an axle operatively connected to a hanger suspending a seat comprising:

a drive sleeve adapted for mounting coaxially and rotatably about said axle, wherein said sleeve is rotatable relative to said axle;

a drive flange adapted for mounting on said axle;

a drive flange coupling device positioned between said drive sleeve and said drive flange and adapted to cause said axle to oscillate with said drive sleeve;

a crank linked to said sleeve for oscillating said sleeve; and a motor for rotating said crank.

24. A swing drive mechanism according to claim 23, wherein said coupling device comprises at least one spring adapted for mounting coaxially and rotatably relative to said axle and collinearly adjacent relative to said sleeve, wherein said spring is positioned to enable engagement with said sleeve.

25. A swing drive mechanism according to claim 24, wherein said coupling device further comprises a hub member adapted for rotatably mounting on said axle, wherein said spring is coaxially mounted to said hub member, said hub member including abutments for engaging with said drive flange, wherein torque applied to said sleeve is transferred to said spring which causes said hub member to rotate and cause said abutments to engage said drive flange and transfer to said axle.

26. A swing drive mechanism according to claim 25, wherein said coupling device comprises two springs coaxially mounted to said hub member, wherein said springs are arranged so that said sleeve can engage one of the two springs and said drive flange can engage the other of said two springs when said sleeve is rotated in one direction, and said sleeve can engage said other spring and said drive flange can engage said one spring when said sleeve is rotated in the opposite direction.

27. A swing drive mechanism according to claim 26, wherein said springs are coiled in opposite directions such that said sleeve and drive flange tend to cause said springs to coil tighter around said hub member, wherein said springs, said hub member and said drive flange provide three spring gradients.

28. A swing drive mechanism according to claim 27, wherein said sleeve is freely rotatable relative to said springs for a limited degree, wherein the free limited degree rotation provides first of said three spring gradients, wherein said sleeve engages one of said springs and the other of said springs engages said drive flange upon rotation of said sleeve beyond said free rotation, causing said two springs to be active, providing second of said three spring gradients, wherein further rotation of said sleeve rotates said hub member along with said sleeve and causes said abutments to engage said drive flange which prevents said hub member from rotating relative to said drive flange, causing said spring engaging said drive flange to be inactive, providing the third spring gradient.

29. A swing drive mechanism according to claim 28, wherein said sleeve includes a channel adapted to run parallel with said axle and said crank has a ball mounted thereon, said ball being mounted in said channel and slideable and relative thereto, said ball being slideably movable and rotatable relative to said crank, whereupon rotation of said crank causes said sleeve to oscillate about said axle and along with said axle.

30. A swing drive mechanism according to claim 29, wherein said crank has an offset driven portion which extends a distance from its axis of rotation, wherein said ball is mounted on said offset portion and orbits about said axis of rotation.

31. A swing drive mechanism according to claim 30, wherein said motor has an output shaft mounted substantially perpendicular to said axle and said crank rotates about said axis that is perpendicular to said output shaft.

32. A swing drive mechanism according to claim 31, further comprising control means adapted for selectively controlling the degree of rotation of said axle.

33. A swing drive mechanism according to claim 32, wherein said control means has means for selectively providing three predetermined different swing amplitudes and includes means for detecting the swing amplitude, wherein said control means controls the swing amplitude based on the amplitude detected and the amplitude selected.

34. An open top support frame for a swing having a pair of hangers suspending a seat comprising:

a rear base;

first and second opposed legs extending upwardly at an angle from ends of said rear base;

a front base;

third and fourth opposed legs extending upwardly at an angle from ends of said front base, wherein said first and third legs converge toward each other, and said second and fourth legs converge toward each other;

a first connector attached to said first and third legs for maintaining said first and third legs at a fixed position relative to each other;

a second connector attached to said second and fourth legs for maintaining said second and fourth legs at a fixed position relative to each other;

a pivot operatively mounted to said first connector;

a second pivot operatively mounted to said second connector;

a hub mounted to each of said first and second pivots, wherein one of said hangers is mounted to one of the hubs and the other of said hangers mounted to the other of said hubs; and an overrotation stop mounted to each of said hubs and a cooperating overrotation stop mounted to each of said first and second connectors adjacent each of said hubs, wherein said stop and said cooperating stop prevent overrotation of said hubs relative to the first and second connectors.

35. An open top support frame according to claim 34, wherein said front base is substantially trapezoidal shaped, defined by a median arm and a pair of oppositely extending arms extending from ends of said medial arm, wherein said third and fourth legs extend from ends of said oppositely extending arms.

36. An open top support frame according to claim 35, wherein said median arm is substantially parallel to said rear base and extends rearwardly toward said rear base.

37. A method of selectively controlling swing heights or amplitudes in a swing that has a motor operated swing drive mechanism comprising the steps of:

providing a selection of at least first and second swing height settings, wherein said first setting is smaller than said second setting;

selectively inputting at least one of no voltage, a predetermined first voltage and a predetermined second voltage to said motor based on the selection of the swing height setting to achieve the selected swing height, wherein said first and second voltages are higher than zero, and said first voltage is lower than said second voltage.

38. A method according to claim 36, wherein upon selection of said first swing height setting, applying said first voltage to said motor.

39. A method according to claim 37, further comprising the step of detecting the swing amplitude.

40. A method according to claim 39, wherein upon selection of said first swing height setting, comprising the steps of:

initially applying said first voltage to said motor;

continuously maintaining said first voltage to said motor until the swing height is greater than said selected first swing height;

applying no voltage to said motor when and if the sensed swing height exceeds said first height setting for the duration of the portion of the swing that exceeds said first swing height.

41. A method according to claim 39, wherein upon selection of said second swing height setting, comprising the steps of:

initially applying said first voltage to said motor;

continuously maintaining said first voltage to said motor until the swing height is greater than said first swing height setting;

applying said second voltage to said motor for the duration of the portion of the swing that is greater than said first swing height setting.

42. A method according to claim 39, further comprising the steps of:

further providing a third swing height setting, wherein said third setting is greater than said second setting; and selectively inputting at least one of said no voltage, said predetermined first voltage, said predetermined second voltage and a third predetermined voltage to said motor based on the selection of the swing height setting to achieve the selected swing height, wherein said third voltage is higher than zero voltage and higher than said second voltage.

43. A method according to claim 42 further comprising the steps of, upon selection of said third swing height setting:

initially applying said first voltage to said motor;

continuously maintaining said first voltage to said motor until the swing height is greater than said first swing height setting;

applying said third voltage to said motor for the duration of the portion of the swing that is greater than said first swing height setting.

44. A method according to claim 43, further comprising the step of, when and if the swing height is greater than said selected third swing height setting, applying said first voltage to said motor for the duration of the portion of the swing that is greater than said third swing height setting.

* * * * *